United States Patent [19]

Kitayama et al.

[11] 4,181,580

[45] Jan. 1, 1980

[54] PROCESS FOR ELECTRO-TIN PLATING

[75] Inventors: Minoru Kitayama; Takao Saito; Ryousuke Wake, all of Himeji, Japan

[73] Assignee: Nippon Steel Corporation, Tokyo, Japan

[21] Appl. No.: 854,198

[22] Filed: Nov. 23, 1977

Related U.S. Application Data

[63] Continuation-in-part of Ser. No. 794,711, May 9, 1977, abandoned, which is a continuation of Ser. No. 628,770, Nov. 4, 1975, abandoned.

[30] Foreign Application Priority Data

Nov. 28, 1973 [JP] Japan ..... 48132794

[51] Int. Cl.[2] ..... C25D 3/30; C25D 5/04; C25D 21/15; C25D 17/00

[52] U.S. Cl. ..... 204/28; 204/54 R; 204/122; 204/206; 204/234

[58] Field of Search ..... 204/54 R, 54 L, 121, 204/122, 28

[56] References Cited

U.S. PATENT DOCUMENTS

| | | | |
|---|---|---|---|
| 652,846 | 7/1900 | Hargreaves | 204/98 |
| 791,555 | 6/1905 | Hemingway | 204/120 |
| 2,304,709 | 12/1942 | Rubin | 204/28 |
| 2,370,973 | 3/1945 | Lang | 204/28 X |
| 2,449,422 | 9/1948 | Smith | 204/49 |
| 2,655,473 | 10/1953 | Lowenheim | 204/121 |

OTHER PUBLICATIONS

First International Tinplate Conference, London 1976 pp. 90–101.

*Primary Examiner*—F. C. Edmundson
*Attorney, Agent, or Firm*—Toren, McGeady and Stanger

[57] ABSTRACT

A method for the electrolytic tinning of steel strip in an electrolytic bath wherein the steel strip is the cathode and insoluble anodes are used, the electrodes are immersed in an electrolyte solution containing tin ions and wherein the concentration of the tin ions in the bath is controlled by passing the solution exterior of the bath in contact with tin in particulate form, while simultaneously maintaining a high content of dissolved oxygen in the solution. This latter treatment replenishes the tin concentration of the solution and the thus replenished electrolytic solution can be returned to the bath in a manner so as to consistently maintain the tin ion concentration at the desired level.

11 Claims, 5 Drawing Figures

PROCESS FOR ELECTRO-TIN PLATING

CROSS-REFERENCE TO RELATED APPLICATIONS

This is a continuation-in-part of copending application Ser. No. 794,711, filed May 9, 1977, now abandoned which, in turn, is a continuation of application Ser. No. 628,770, filed Nov. 4, 1975, now abandoned which, in turn was a continuation-in-part application of Ser. No. 481,325, filed June 20, 1974 now abandoned. The contents of said prior applications being incorporated herein by reference.

BACKGROUND OF THE INVENTION

1. Field of the Invention

The present invention relates to an improved process for electrolytic tinning on metallic bodies especially on steel strip for the production of tinplate, and concerns in particular such processes carried out using insoluble anodes that eliminate all of the difficulties in the previous process of electrolytic tinning using tin anodes.

2. Description of the Prior Art

The electrolytic tinning of metallic bodies, for example, electro-tinning of steel strip, is conventionally effected by making the surface to be plated the cathode in an aqueous solution of tin salt, such as, stannous sulfate, stannous chloride or stannous fluoborate, in an acid bath and sodium stannate or potassium stannate in an alkaline bath. In the electrolytic process, passing a direct current through the bath from an anode to the cathode causes the reduction of tin ions into metallic tin which deposits out of the solution onto the surface of the cathode. The electrolytic reduction of tin ions on the cathode is:

$$Sn^{2+} + 2e \rightarrow Sn(\text{metal}) \text{ (in acidic bath)} \quad (1)$$

$$SnO_3^{2-} + 3H_2O + 4e \rightarrow Sn(\text{metal}) + 6OH^- \text{ (in alkaline bath)} \quad (1')$$

If the electrolytic tinning solution is operated continuously, then clearly more tin ions must be fed into the solution to compensate or replenish those that have plated out. This can be effected either by using a tin anode from which tin is dissolved by electrolytic anodic dissolution, or by adding more tin salt.

The use of a soluble tin anode has the theoretical advantage in that the plated-out tin from the solution can automatically be compensated for by the electrolytic anodic dissolution, i.e., reaction (2) or (2'):

$$Sn \rightarrow Sn^{2+} + 2e \text{ (in acidic bath)} \quad (2)$$

$$Sn + 6OH^{31} \rightarrow SnO_3^{2-} + 3H_2O + 4e \text{ (in alkaline bath)} \quad (2')$$

Thus, theoretically, reaction (2) or (2') should occur at a rate that exactly balances with reaction (1) or (1'). In practice, however, other factors cause an imbalance to occur and also cause other disadvantages.

Firstly, simultaneous electrolytic reactions occur on the surface of both electrodes and cause a difference in the current efficiency between the anode and the cathode, which results in a build-up of ions in the elecrolytic tinning solution. For an acid electrolytic tinning, the anode current efficiency is almost 100%, however, the cathode current efficiency is 95 to 97% because of the simultaneous generation of hydrogen on the cathode according to reaction (3):

$$2H^+ + 2e \rightarrow H_2(\text{gas}) \quad (3)$$

This produces an excessive supply of tin ions into the bath, and hence results in an increase in the tin ion concentration of the electrolytic tinning solution.

In an alkaline electro-tinning operation, the simultaneous generation (3') reduces the cathode current efficiency to about 90%:

$$2H_2O + 2e \rightarrow 2OH^- + H_2(\text{gas}) \quad (3')$$

Through the electrolytic dissolution of tin anode in the alkaline bath, tin can dissolve in either the stannite or the stannate form. Since stannite ions cause quite unsatisfactory deposits, the anode must disolve as stannate. In such conditions, the anodic reactions on the anode involve the simultaneous oxygen evolution (4') which reduces the anode current efficiency to the region between 75 and 90%:

$$4OH^- \rightarrow 2H_2O + O_2(\text{gas}) + 4e \quad (4')$$

Thus, the difference of current efficiency between the anode and the cathode causes a decrease in the tin ion concentration and an increase of free alkali in the alkaline electro-tinning bath. The lack of tin ions in the solution must be compensated for by the addition of stannate chemicals which results in an alkali build up in the alkaline tinning solution.

For the electro-tinning operation to proceed smoothly, the concentration of bath constituents should be maintained within a predetermined range by analytical control, so that the excessive ions must be removed from the system. This operation is usually effected by draining part of the solution off and replacing it with tin-free solution in the case of an acid electro-tinning, or with tin-containing and free-alkali-free solution in the case of an alkaline electro-tinning. However, drainage of the tinning solution results in the loss of expensive chemicals on the one hand, and possibly some environmental pollution on the other hand.

Secondly, during the continuous electro-tinning operation, the soluble tin anode is consumed and eventually deformed. This causes a continuous change in the distance between the anode and the cathode which makes it difficult to maintain a steady distribution of deposited tin over the surface to be plated. Thus, frequent adjustment of the inter-electrode distance is necessitated during the electro-tinning operation.

The tin anode must be renewed when it has been consumed beyond a certain point. However, the labor cost required for casting a new anode and in replacing the consumed anode with a new one considerably large. This is particularly so in the modern electro-tinning line for the production of tinplate, where the tin is consumed at a high rate and replacement has to be effected often.

There are also other reasons why the use of a soluble tin anode causes difficulties. For example, tin anodes are usually divided into several pieces for convenience in either adjusting or replacing them. The anode handling in such practices is apt to introduce an unequal current density between the divided anodes due to different contact resistances at the current-feeding spots. This causes not only a non-uniform distribution of tin plated on the cathode, but also unsatisfactory deposits due to the improper current distribution.

Accordingly, in spite of the theoretical advantages of soluble anodes, it is preferred to employ insoluble anodes. Using an insoluble anode, the cathodic reactions are the same as when using a soluble tin anode, but the anodic reaction is merely the oxygen evolution reaction (4) or (4'):

$$2H_2O \rightarrow O_2 + 4H^+ + 4e \text{ (in acid bath)} \quad (4)$$

$$4OH^{31} \rightarrow O_2 + 2H_2O + 4e \text{ (in alkaline bath)} \quad (4')$$

Conventionally, the plated-out tin is compensated for by the addition of tin salts to the bath.

Unfortunately, this, too, is not without its disadvantages. In particular, the replacement of the plated-out tin with a tin salt inevitably causes an enormous build-up of ions in the electro-tinning solution. For instance, the continuous addition of stannous salt into an acid bath causes a build up of anions, and the continuous addition of alkali stannate into an alkaline bath causes an alkaline build up. This build up of ions is invariably deleterious and makes it impossible to use an insoluble anode continuously in modern electro-tinning processes. However, the known art has provided no way of overcoming this problem. The removal process of the built up ions is not easy in itself and causes a tremendous loss of chemicals.

As is made clear hereinbefore, when using an insoluble anode in continuous electro-tinning, it is necessary to supply sufficient tin to the tinning solution in order to compensate for the plated-out tin. Adding the tin as a tin salt, however, causes difficulties as a result of the build up of other ions.

Consequently, we have considered the possibility of adding the tin as metallic tin to the electro-tinning solution which then dissolves chemically in the solution to give the required content of tin ions. Unfortunately, however, the normal rate of chemical dissolution of metallic tin in the electro-tinning solution is so small in comparison with the rate at which tin is plated out from the solution by electrolysis that it is extremely difficult, or rather actually impossible to supply tin ions fast enough to balance their consumption in a continuous electro-tinning process.

According to our studies, the chemical dissolution rate of metallic tin as actually measured for a particular electro-tinning solution was at the most 0.1 mg/cm$^2$-hr, corresponding to a plating current of less than 0.0045 A/dm$^2$. On the other hand, the plating current in the same solution was actually from 20 to 40 A/dm$^2$, that is, from 5000 to 10,000 times greater than the chemical dissolution rate of metallic tin.

Thus, the plating-out rate is so large that, under normal conditions, it is not practical to replace the plated-out tin by adding metallic tin to the electro-tinning solution. This is the reason why the prior art has had to rely on adding a tin salt to the electro-tinning solution in order to compensate for the plated-out tin, when using an insoluble anode. Therefore, it is inevitable that the previously known processes for continuous electro-tinning used soluble tin anodes and that the use of insoluble anodes is very limited.

A particular problem which thus results with all of these prior art processes is that it is extremely difficult to control or minimize the variations in the tin ion concentration from the desired value under the particular conditions of the process.

SUMMARY OF THE INVENTION

We have now discovered that if certain conditions are met, the supply of tin ions to an electro-tinning solution using an insoluble anode at a rate fast enough to balance the plating-out rate can advantageously be accomplished by adding metallic tin to the solution. This procedure overcomes most, if not all, of the difficulties previously encountered in the use of either soluble or insoluble anodes.

In one aspect, therefore, this invention provides a process for electro-tinning using insoluble anodes in an electro-tinning solution of a tin salt onto a conductive surface as the cathode wherein the plated-out tin in the solution is replenished.

More particularly, this invention provides a new electro-tinning process for the producton of tinplate without using a tin anode which possesses the following advantages in comparison with previous processes:

(a) complete recirculation of the solution without discharge, thus avoiding the loss of materials and possible water pollution;
(b) elimination of labor requirements and metal loss in casting tin anodes;
(c) elimination of labor requirements for anode replacement in the electro-tinning operation;
(d) constant and reduced distance between the strip and anode which is advantageous in making tin distribution uniform and in saving metal and electrolytic energy;
(e) substantial improvement in the control and minimization of the deviation of the tin ion concentration from the desired value.

It is noted that as used herein, the term "tin ions" is intended to mean divalent or tetravalent tin depending on whether the term is being used in the context of an acid or alkaline bath, respectively.

A principal feature of this invention lies in the method of replenishing tin ions to the electro-tinning solution by the chemical dissolution of metallic tin in a fluidized bed which consists of metallic tin particles and the electro-tinning solution having a sufficient dissolved oxygen content, wherein the metallic tin chemically dissolves through the consuming reaction of the dissolved oxygen.

According to our studies, the reason why the rate of chemical dissolution of metallic tin is so small in the electro-tinning solution is that tin has a small ionization tendency and a large hydrogen overpotential. In the electro-tinning solution, a hydrogen evolution reaction (5) and (5') contributes only slightly to the chemical dissolution of metallic tin:

$$Sn + 2H^+ \rightarrow Sn^{2+} + H_2 \text{ (in acid bath)} \quad (5)$$

$$Sn + 2OH^- + H_2O \rightarrow SnO_3^{2-} + 2H_2 \text{ (in alkaline bath)} \quad (5')$$

Tin dissolves through the reduction of the dissolved oxygen (6) or (6') of which the rate determining step is the mass transfer of dissolved oxygen from the bulk of the solution to the reactive interface:

$$2Sn + O_2 + 4H^+ \rightarrow 2Sn^{2+} + 2H_2O \text{ (in acid bath)} \quad (6)$$

$$Sn + O_2 + 2OH^- \rightarrow SnO_3^{2-} + H_2O \text{ (in alkaline bath)} \quad (6')$$

The over-all reaction rate, that is, chemical dissolution rate of metallic tin, is determined by the concentration and the diffusion rate of dissolved oxygen in the electro-tinning solution, both of which are very low under normal conditions.

We have now found that it is possible to raise the chemical dissolution of metallic tin in the electro-tinning solution such that metallic tin can be added to the solution in order to make up the plated-out tin. This makes it possible to employ an insoluble anode continuously in the electro-tinning process, provided the following conditions are met:

(a) sufficient exposure of reactive surface area of metallic tin;
(b) reduction in the thickness of the diffusion layer of dissolved oxygen at the reactive interface;
(c) positive supply of dissolved oxygen to the reactive interface;
(d) maintenance of sufficient dissolved oxygen content in the bulk solution.

These conditions are met in the present invention by using a bed in the form of granular metallic tin exterior of the electrolytic bath as a reaction bed for the chemical dissolution of metallic tin and the electro-tinning solution of sufficient dissolved oxygen content. The use of metallic tin particles ensures a sufficient exposure of reactive surface area for chemical dissolution. Continuous feed of the solution into the bed causes a vigorous flow of the solution and/or motion of the tin particles in the bed, which reduces the diffusion layer of dissolved oxygen on the reactive interface through turbulent diffusion and increases the mass transfer rate of the dissolved oxygen to the interface. A sufficient content of dissolved oxygen in the feed solution ensures a positive supply of dissolved oxygen to the reaction bed and is maintained by the positive absorption of molecular oxygen. These details are explained hereinafter.

As a result, the dissolution of the particulate tin into the solution can be maintained at a relatively high rate and by controlling the contacting rate and the rate of recirculation of the replenished tin ion containing solution to the bath, it becomes possible to easily control the tin ion concentration in the bath at a desired level while minimizing the deviation from this level.

DETAILED DESCRIPTION OF THE INVENTION

Figure 1:
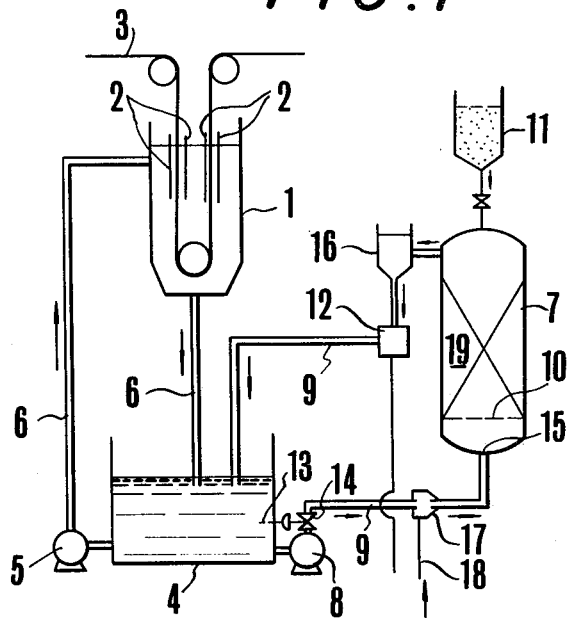
FIG. 1 is a schematic diagram of the process in accordance with the present invention.

Referring to FIG. 1, shown in a single plating tank 1 which is representative for the plating tanks conventionally used, a solution recirculation tank 4, and a fluidized bed reactor 7 of replenishing the plated-out tin.

The plating tank 1 contains insoluble anodes 2, the strip to be plated 3 as the cathode, and the electro-tinning solution. The fluidized bed reactor 7 contains a perforated partition or distributor 10, a bed 19 of metallic tin particles thereon, and the electro-tinning solution.

In the tinning operation, the solution is continuously circulated via a pump 5 and pipelines 6 and 6', between the circulation tank 4 and the plating tank 1. In the plating tank 1, tin ions in the solution are plated out onto the strip cathode 3, while on the anodes 2 the anodic reaction merely generates oxygen, and hence causes the decrease of the tin ion concentration in the circulating solution.

The variation of tin content in the solution between a predetermined and an actual value in the circulation tank 4 is detected by a detector 13, the signal from which controls the opening of control valve 14, through which the solution in the tank 4 is pumped up to the bottom inlet 15 of the reactor 7 via a pump 8 and a pipeline 9.

The fluidized bed reactor 7 is associated with a hopper 11 containing metallic tin particles, and these are continuously or intermittently fed into the top of the reactor 7. The perforated partition 10 in the reactor 7 supports the bed 19 of metallic tin particles, and prevents any particles from falling down to the bottom of the reactor 7.

If the flow rate of the solution fed into the reactor 7 is low and the space velocity of the solution flow in the reactor 7 is less than the minimum space velocity for fluidization, then the bed 19 of metallic tin particles formed above the partition 10 behaves as a fixed or settled bed. The solution flows upward through the interstices between the particles, while the particles remain settled in a settled state.

If the flow rate of the solution is high enough to exceed the minimum space velocity for fluidization in the reactor 7, then the bed 19 of metallic tin particles behaves as a fluidized bed. The ascending flow of the solution lifts the particles, increasing the voidage of the bed 19 and decreasing the intersticial velocity of the solution until the upward drag exerted on the particles by the solution just balances to the weight of the particles. Thus, the metallic tin particles are freely suspended in a fluidized bed and move in violent motion.

In the fluidized bed 19, metallic tin particles dissolve as the result of the reducing reaction of the dissolved oxygen (6) or (6') in the solution fed into the reactor 7:

$$2Sn+O_2+4H^{30}\rightarrow 2Sn^{2+}+2H_2O \text{ (in acid bath)} \quad (6)$$

$$Sn+O_2+2OH^-\rightarrow SnO_3^{2-}+H_2O \text{ (in alkaline bath)} \quad (6')$$

The dissolved amount of metallic tin into the solution is so controlled by the feed rate of the dissolved oxygen into the reactor, that the plated-out tin in the plating tank 1 using the insoluble anodes 2 is easily compensated for by passing the solution through the bed 19.

Thus, the replenished solution overflowing the top of the reactor 7 is then passed, via a separator 16, a filter 12, and pipeline 9', back to the circulation tank 4 and hence, via the pump 5 and the line 6', back to the plating tank 1.

As pointed out hereinbefore, the use of insoluble anodes 2 in the plating tank 1 merely results in the evolution of oxygen according to the anodic reaction (4) or (4'):

$$2H_2O\rightarrow O_2+4H^++4e \text{ (in acid bath)} \quad (4)$$

$$4OH^-\rightarrow O_2+2H_2O+4e \text{ (in alkaline bath)} \quad (4')$$

If this oxygen dissolved in its entirety into the solution, the dissolved oxygen required for the reaction (6) or (6') in the reactor 7 provided would be stoichiometrically sufficient to compensate for the plated-out tin in the plating tank 1. Unfortunately, however, the solubility of the oxygen gas in the solution is so low under normal conditions that the bulk of oxygen gas evolved on the anodes 2 merely bubbles up through the solution in the plating tank 1 and is released from the system.

Therefore, it is necessary to provide additional oxygen to the solution fed into the reactor 7, which dissolves therein so as to ensure a sufficient content of dissolved oxygen in the solution and supply to bed 19, the amount of dissolved oxygen required for the reaction so as to compensate for the plated-out tin.

This operation is effectively carried out by installing a suitable absorber at the feed line of the solution to the reactor, wherein the solution comes in sufficient contact with a molecular oxygen containing gas, such as, pure oxygen and air, and then is saturated therewith to keep its dissolved oxygen content high.

For this purpose, in the apparatus shown in FIG. 1, the pipeline 9 incorporates a venturi 17 at which oxygen gas or air may be passed into the solution via the line 18 and intimately mixed with the solution to keep it saturated therewith.

In this invention, the use of a fluidized bed as the reaction bed is advantageous in keeping a sufficient amount of oxygen dissolved in the solution fed into the reactor 7. That is because the fluidization of the metallic tin particles causes a bed pressure drop corresponding to the weight of bed in the solution flow per unit area of reactor. This, in turn, ensures a constant and high static pressure at the bottom of reactor 7 and results in increasing the solubility of oxygen in the feed solution.

At the upper part of the reactor 7, where the decrease of static pressure results in the decrease of solubility of gases in the solution, a part of dissolved gases in the solution is released from the solution in the form of fine bubbles. These fine bubbles of released oxygen in the bed and/or those of the undissolved oxygen supplied in slight excess at the venturi 17 act to keep the dissolved oxygen content of the bed 19 saturated under operational static pressure.

Thus, in the fluidized bed 19, the dissolution reaction of metallic tin proceeds under conditions of turbulent diffusion of dissolved oxygen and higher dissolved oxygen content in the solution, both of which ensure to increase the mass transfer rate of dissolved oxygen from the solution bulk to the reactive interface.

The increase of the dissolution rate of the metallic tin is quite surprising. For example, in a phenolsulphonic acid electro-tinning solution at 45° C., metallic tin dissolves under normal electro-tinning conditions, at a rate of 0.08 $mg/cm^2$-hr per unit area of reactive surface, while the use of a fluidized bed pushes the rate up to 0.7 $mg/cm^2$-hr under the normal dissolved oxygen content in the solution. Furthermore, the saturation of air or oxygen at 1 atm. into the solution fed into the fluidized bed provides for dissolution rates of the order of 2.0 $mg/cm^2$-hr and 9.7 $mg/cm^2$-hr, respectively.

Thus, in the present invention, the dissolution rate of metallic tin can be more than 100 times greater than the normal dissolution rate.

It is noted that the desired tin ion concentration in the bath depends on a number of parameters, e.g., the type of electrolyte in the bath, the temperature at which it is desired to carry out the plating, etc. As a result, the tin dissolution rate and the oxygen dissolution rate will vary depending on the specifics of the particular process. The important aspect of the present process is, however, that it now becomes possible to minimize the variation of the tin ion concentration from the desired value. In fact, using the present process, it is possible to control the tin ion concentration to within ±1 g/l and, preferably, 0.5 g/l of the desired value.

The tin particles used in the process of this invention are small and have a large specific surface area. The size distribution of metallic tin particles supplied from the hopper 11 to the reactor 7 plays an important role in optimizing the replenishing operation in the reactor 7. Granulated tin is the preferred form of tin particles in order to keep the particles of bed 19 in a state of uniform fluidization. It is also preferable for about 90 weight % of the tin particles supplied to pass through Tyler 3.5 mesh and to be retained on Tyler 20 mesh in sieve analysis because of the following reasons.

According to our studies, the rate of dissolved oxygen consumption in bed 19, that is, the dissolution rate of metallic tin particles according to the reaction (6) or (6') in bed 19, is given by the following equation (7).

$$G = C_o \cdot L \cdot [1 - \exp\{-V/L \cdot k_f \alpha \cdot (1-\epsilon)\}] \quad (7)$$

where

G: dissolution capacity of the reactor 7, $C_o$: dissolved oxygen content in the feed solution at the entrance of the bed 19, V: effective volume of the bed 19, L: flow rate of the feed solution, $k_f$: mass transfer coefficient of the dissolved oxygen in bed 19, $\alpha$: specific reactive surface area of tin granules, $\epsilon$: fraction voids of the bed 19.

From equation (7), it is clear that the dissolution capacity of the given reactor 7 becomes greater in proportion to the feed rate of dissolved oxygen, $C_oL$, to the reactor. However, a term given in parentheses in the equation (7), which relates to the effective utilization of dissolved oxygen feed in the bed 19, also produces a powerful effect on the dissolution capacity.

A bed of tin particles which have a much larger size causes decrease in the reactive surface area $\alpha$ and the mass transfer coefficient $k_f$, and hence, a decreased utilization of dissolved oxygen in the bed, which results in decreasing the dissolution capacity of the given reactor.

Although having the advantage of increasing the reactive surface area $\alpha$, the use of much smaller size tin particles causes such an increase in the fraction voids $\epsilon$ of the bed at the given flow rate of the solution, that the effective utilization of dissolved oxygen in the bed does not significantly increase. Moreover, a decrease in the terminal velocity of the particles increases the carry over of particles from the bed by the solution overflow, which causes elutriation loss and hence, a decrease in the effective utilization of the metallic tin particles.

Supplying the molecular oxygen-containing gas in slight excess into the feed solution to reactor 7 is advantageous in ensuring a sufficient dissolved oxygen content $C_o$ in the feed solution at the entrance of the bed 19. However, an excessive supply using venturi 17 is not advantageous in increasing the dissolution capacity of the reactor 7 and causes a decrease in the effective utilization of oxygen gas feed.

An excessive supply of the gas results in an increased amount of undissolved gas bubbles in the solution fed into the bed 19. These bubbles cover the surface of the metallic tin particles in the bed and thus decrease the liquid/solid interface, that is, the effective reactive surface area $\alpha$ for the dissolution reaction. This, in turn, decreases the dissolution capacity of the reactor. The ratio of excessive oxygen gas feed to the solution should be maintained within 160% compared to the theoretical saturated dissolved oxygen feed under the given conditions at the entrance of bed 19. Thus, with the present invention, it is possible to replenish the plated-out tin without using a tin anode and without the problems encountered due to build up of ions in the electro-tinning solution.

The compact dissolution reactor used in the present invention makes it possible in a modern electro-tinning line for the production of tinplate to plate electrolytically steel strip with the exclusive use of insoluble anodes, to replenish the plated-out tin in the solution through the dissolved oxygen reducing reaction with metallic tin, and hence, to overcome the difficulties previously encountered with either soluble or insoluble anodes.

Figure 4:
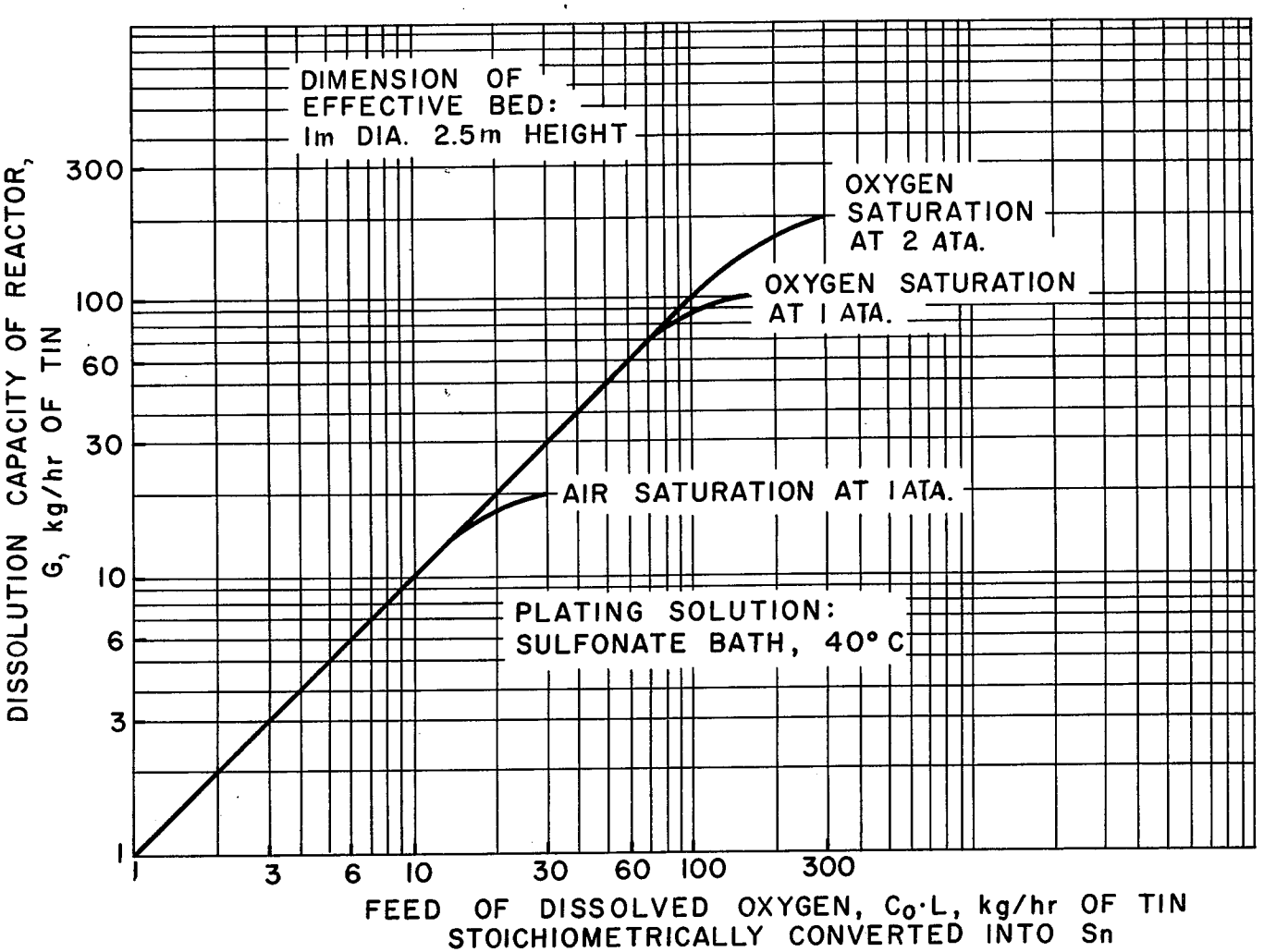
FIG. 4 is a graph showing the variation in the chemical dissolution capacity of metallic tin in a fluidized bed reactor with amount of dissolved oxygen feed.

FIG. 4 graphically shows an example of the dissolution capacity of a fluidized bed reactor having an effective bed size of 100 cm in diameter and 250 cm in height, installed in an acid electro-tinning line which has six plating cells with a maximum plating-out rate of 200 kg/hr of tin. As can be seen from FIG. 4, the dissolution rate of metallic tin particles in the bed depends on the feed rate of dissolved oxygen into the bed and the replenishing process in the present invention ensures a sufficient capacity to replenish the entire amount of plated-out tin of the solution.

As noted above, when the solution feed rate to reactor 7 is so low that the space velocity of the solution in the reactor 7 does not reach the required minimum velocity for fluidization, bed 19 of the metallic tin particles behaves as a fixed or settled bed, the dissolution capacity of which is also given by equation (7).

Compared with a fluidized bed in which the expansion causes an increase in the fraction voids $\epsilon$, such a fixed or settled bed has a smaller dissolution capacity resulting from a lower feed rate of the solution L, though it does posses the advantage of having smaller fraction voids. However, if conditions are met which ensure a high dissolved oxygen content in the solution at the entrance of the fixed or settled bed, the supply of tin ions to the solution can also be accomplished by employing a fixed or settled reactor. Compared to a fluidized bed reactor, the fixed or settled bed is advantageous in having a smaller amount of fraction voids $\epsilon$, a lower feed rate L of the solution, and hence, higher effective utilization of the dissolved oxygen. These conditions are effected by keeping the operational static pressure of the reactor high enough to increase the solubility of oxygen gas in the feed solution at the entrance of the bed.

Figure 2:
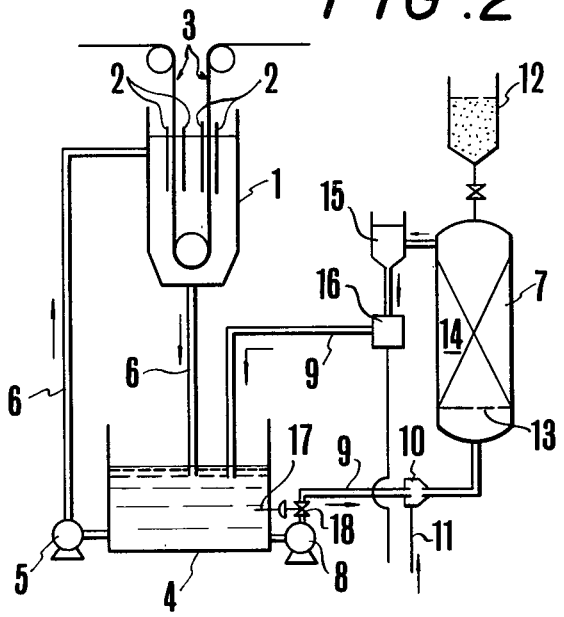
FIG. 2 is an embodiment similar to that of FIG. 1 of another process in accordance with the present invention.

FIG. 2 shows a modified embodiment of an apparatus having a fixed or settled bed reactor for use in the present invention.

In FIG. 2, 1 is a single plating tank representing the conventional plating tanks, 2 are insoluble anodes, 3 is the strip to be plated as the cathode, and the electro-tinning solution is circulated via a pipeline 6 between a circulation tank 4 and the plating tank 1 by means of a pump 5. 7 is a fixed or settled bed reactor. The decrease of tin ions in the solution in the circulation tank 4, which is caused by the use of the insoluble anodes 2, is compensated for by supplying tin ions through circulating the solution between the reactor 7 and the circulation tank 4 by means of a pump 8.

A venturi mixer 17 is provided in pipeway 9 on the inlet side of the dissolution reactor 7, and works to mix and dissolve an oxygen-containing gas introduced through a pipeline 18, into the solution travelling via the pump 8 by the venturi action so as to deliver an electro-tinning solution having a high dissolved oxygen content to the bottom of the dissolving reactor 7. At the bottom of the reactor 7, a perforated plate 10 is provided, which serves to support the particles of metallic tin supplied through the hopper 11 and to uniformly distribute the feed solution introduced from below, into a fixed or settled bed 20 of metallic tin particles. Further, metallic tin particles are supplied either successively or continuously to the dissolving reactor 7 from hopper 11 above the reactor 7.

Tin particles supplied to the reactor 7, which form a fixed or settled bed 20 and contact the upward flow of the electro-tinning solution, dissolve chemically according to equation (6) or (6'). The operational static pressure required for keeping the high solubility of oxygen gas in the solution at the entrance of the bed 20 is ensured by the pressure loss of the upward flow of the solution through the height of bed 20 and/or by installing a pressure controlling device at the outlet of reactor 7. A gas-liquid separator 16 and a filter 17 are installed in pipeline 9' on the outlet side of the dissolution reactor 7, which serves to separate gas and liquid in an emulsion and to recover the very small particles of tin carried away from bed 20.

In the circulation tank 4 for the electro-tinning solution, a detector 13 for either pH or tin ion concentration, or both of them, is provided. The signal from the detector controls the flow rate of the feed solution into reactor 7 by controlling valve 14 to maintain a constant concentration of tin ions.

Another modification of the apparatus for use in the present invention is also possible so long as the reactor is designed to meet the following four conditions:

(a) sufficient exposure of reactive surface area,
(b) reduction of the diffusion layer of dissolved oxygen,
(c) positive supply of dissolved oxygen to the reactive inerface,
(d) sufficient dissolved oxygen content in the bulk solution.

Figure 3:
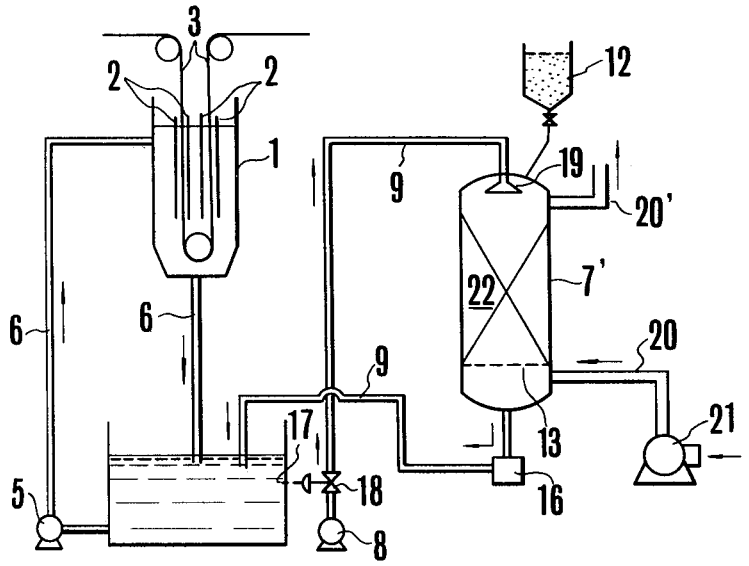
FIG. 3 is a schematic diagram of yet another embodiment of the present invention.

FIG. 3 shows a modification of the apparatus wherein a trickling bed reactor of the packed tower type is used. The flow of the solution through the replenishing reactor 7 is in the reverse direction to that of FIG. 1 and FIG. 2, but otherwise the apparatuses are similar.

The trickling bed reactor 7 of the packed tower type is provided with a perforated partition 10 beneath the packed bed 22 of metallic tin to prevent loss of the metallic tin particles supplied from the hopper 11 and at the same time, to distribute an oxygen-containing gas introduced via line 23 by a blower 24. The electro-tinning solution is fed by a pump 8 to the upper part of the bed 22 via a pipeline 9 and a distributor 21, and returns to the circulation tank via filter 12 and return line 9'. Exhausted gas is vented via pipeline 23.

In the trickling bed, the solution flows downward through the packed bed 22, wetting the surface of the metallic tin, while the gas flows upward through the interstices of the bed 22 counter-current to the flow of the solution. In order to ensure sufficient interstices through which the gas flows upward in the packed bed 22, it is preferable as the metallic tin supplied from the hopper 11 to use shaped metallic tin packings of which the configuration is, for example, a cylindrical ring like a Raschig ring. The specific surface area of such shaped packings is to be from 50 to 1200 $m^2/m^3$ per unit volume of the random packed bed.

Thus, through the counter-current contact of the solution with the gas, molecular oxygen dissolves into the liquid film of solution on the surface of metallic tin, then the dissolved oxygen is transferred to the reactive interface between the metallic tin and solution, and reduced by the dissolution reaction of the metallic tin.

EXAMPLE 1

A steel strip was subjected to a continuous tin plating operation in a phenolsulfonate bath containing 30 g/l of stannous tin and 20 g/l of free acid calculated as $H_2SO_4$. The operation was carried out using insoluble platinized titanium anodes with a plating current density of from 20 to 40 $A/dm^2$ and at 40° C., so as to theoretically give a plating weight of 11.5 $g/m^2$, and the steel strip was passed through the plating cells at an area rate of 900 $m^2/hr$. The plated-out tin from the bath was replenished, using metallic tin particles of from 1 to 2 mm average diameter in a fluidized bed reactor installed in the solution circulation system.

The initial charge of metallic tin particles of 700 kg formed the reaction bed of metallic tin in the reactor, the particulate fluidization of which was maintained by pumping the solution therethrough at a space velocity of 20 cm/sec. The feed rate of the solution to the reactor was 50 $m^3/hr$, into which pure oxygen gas was mixed and dissolved at the rate of 1000 l/hr by using a venturi.

In 24 hours of continuous operation, the average plating weight was 11.0 $g/m^2$, giving a plating-out rate of 9.9 kg/hr of tin. The charging rate of metallic tin particles to the reactor was 10 kg/hr, and the particles in the fluidized bed dissolved at a rate of 14 g/kg-hr, corresponding to the replenishing rate of 9.8 kg/hr of stannous tin into the solution.

The carry over of small tin particles by the solution at the outlet of the reactor was 120 g/hr and was counted as the elutriation loss.

The tin ion concentration in the plating solution could be controlled at an almost constant value: it was 30.0 g/l in the initial stage and 29.7 g/l 24 hours later. The distribution of the tin deposit on the strip was so uniform that the difference between the maximum and the minimum plating weight was only 0.2 $g/m^2$.

COMPARISON EXAMPLE

For the sake of comparison, a similar continuous tinning operation was conducted in a conventional manner using soluble tin anodes. The current efficiency at the cathode was 95% and the stannous tin ion concentration increased from 30 g/l to 31.2 g/l in 24 hours operation. When a current density as high as 40 $A/dm^2$ was employed, an oxide film was formed on the surface of the tin anode; this then peeled off making the plating solution dirty and turbid and causing a dirty appearance on the plated surface. The difference between the maximum and minimum plating weight was 0.8 $g/m^2$ even though the anodes were frequently adjusted.

EXAMPLE 2

A continuous electro-tinning operation of steel strip was conducted in a manner identical to that of the inventive process of Example 1, except that the replenishing of the plated-out tin into the plating solution was effected by using a fixed bed reactor.

The reactor was initially charged with 3000 kg of metallic tin particles of 3 to 4 mm average diameter, which settled upon a perforated plate in the reactor, forming a fixed bed of particles for metal dissolution. The plating solution saturated with air at 1 atm was pumped upward through the bed at a space velocity of 10 cm/sec.

Through the operation, tin particles were fed into the reactor at the rate of 10 kg/hr, while the dissolution rate of metallic tin was 3.3 g/kg-hr per unit weight or 17 $kg/m^3$-hr per unit volume of fixed bed, corresponding to the replenishing rate of 9.8 kg/hr of stannous tin into the solution.

The tin ion concentration in the plating solution was controlled to almost a constant value: initially it was 30.0 g/l, while after 24 hours, it was 29.5 g/l.

Thus, the present invention makes it possible to successfully overcome all of the difficulties previously encountered in using either soluble or insoluble anodes in the electro-tinning of steel strip in the prior art. The application of the present invention makes it possible in industrial uses to successfully plate the strip continuously through the exclusive use of insoluble anodes and through the replenishment of the plated-out tin to the solution, while avoiding the difficulties encountered in the prior art.

Also, while the above examples have only described the application in electro-tinning using a phenolsulfonate bath, the present invention may be also be used in other electro-tinning baths, such as, sulfate baths, fluoroborate baths, and alkaline baths.

What is claimed is:

1. In a process for the electrolytic tinning of steel strip to produce tin plate wherein insoluble anodes are used and the steel strip as the cathode are immersed in an electrolysis bath vessel, the bath being composed of an acidic electrolyte solution containing stannous ions, whereby the stannous ions in the solution are consumed and tin is plated onto the strip, the improvement which comprises, replenishing and controlling the stannous ion concentration of the solution by contacting the solution exterior of the vessel with a bed of particulate elemental tin while simultaneously introducing an oxygen containing gas to said solution in a manner so as to provide a sufficient amount of dissolved oxygen in the solution in contact with the particulate tin to dissolve said tin into said solution at a rate sufficient to make up for the loss of stannous ions due to the plating-out thereof and circulating the thus contacted solution back to the vessel at a rate sufficient to minimize the deviations of the stannous ion concentration in the bath from the desired value.

2. The process of claim 1 wherein the contacting step is carried out by continuously removing solution from the electrolysis vessel, contacting the removed solution with an oxygen containing gas to saturate the solution with dissolved oxygen and passing the thus saturated solution along with any remaining gaseous oxygen upwardly through a bed of particulate tin whereby tin dissolves into said solution and recycling said thus contacted solution to the electrolysis vessel at a rate sufficient to replenish the depleted tin concentration and to control the tin concentration in the vessel at a substantially constant level.

3. The process of claim 2 wherein the contacted solution along with any remaining gaseous oxygen is passed upwardly through the bed at a space velocity sufficient to place said bed in a state of fluidization.

4. The method of claim 1 wherein said contacting step is carried out by continuously removing solution from the electrolysis vessel and trickling said solution downwardly through a bed of particulate tin while simultaneously passing an oxygen containing gas upwardly through the bed counter-current to the flow of the solution, the combination of the surface area of the tin particles and the rates of counter-current passage of the solution and oxygen containing gas through the bed being effective to at least replenish the depleted tin from said solution and then recycling the thus contacted solution to the electrolysis vessel at a rate sufficient to maintain the tin concentration in the vessel at a substantially constant level.

5. The method of claim 4 wherein the tin is in the form of a granular particulate of which about 90 percent by weight passes a Tyler 3.5 mesh and is retained on a Tyler 20 mesh.

6. The method of claim 4 wherein the tin is in the form of shaped metallic tin packings having a specific surface area of about 50 to 1,200 $m^2/m^3$ and a fractional void volume from about 0.6 to 0.9 $m^3/m^3$ per unit volume of the packed bed.

7. The method of claim 1 wherein the tin is in the form of tin granules of which about 90 percent by weight passes a Tyler 3.5 mesh and is retained on a Tyler 20 mesh.

8. The process of claim 1 wherein the contacting step is carried out at an operational static pressure higher than atmosphere pressure.

9. The process of claim 1 wherein (a) solution being depleted in tin concentration is continuously removed from the electrolysis vessel into a reservoir;

(b) solution is continuously removed from the reservoir to the contacting step wherein the tin concentration is replenished;

(c) said tin replenished solution is removed from the contacting step and returned to the reservoir; and wherein the rate of removal and return of solution in steps (b) and (c) are controlled so as to keep the average tin concentration of the solution in the reservoir at a constant desired level, and (d) said solution of controlled tin concentration is returned to said electrolysis vessel.

10. The process of claim 1 wherein the deviation of the tin ion concentration from the desired value is less than about ±1 g/l.

11. The process of claim 10 wherein the deviation of the tin ion concentration from the desired value is less than about ±0.5 g/l.

* * * * *